US005603679A

United States Patent [19]

Reis

[11] Patent Number: 5,603,679

[45] Date of Patent: Feb. 18, 1997

[54] GRIPPING DEVICE

[76] Inventor: Pedro Reis, 4005 Nelson Ave., Sarasota, Fla. 34231

[21] Appl. No.: 434,546

[22] Filed: May 4, 1995

[51] Int. Cl.[6] ..... A63B 21/00

[52] U.S. Cl. ..... 482/106; 482/49; 482/48; 2/20; 2/16

[58] Field of Search ..... 2/16, 20; 482/49, 482/106; 602/21; 128/874; 152/367

[56] References Cited

U.S. PATENT DOCUMENTS

| | | | |
|---|---|---|---|
| 591,501 | 10/1897 | Schonborn | 152/367 |
| 2,235,313 | 3/1941 | Cleveland | 2/20 |
| 2,547,388 | 4/1951 | Griffin | 2/20 |
| 3,896,498 | 7/1975 | Pang | 2/20 |
| 4,617,684 | 10/1986 | Green et al. | 2/20 |
| 4,754,499 | 7/1988 | Pirie | 2/20 |
| 5,350,343 | 9/1994 | Da Silva | 482/93 |

*Primary Examiner*—Jerome Donnelly
*Attorney, Agent, or Firm*—Charles J. Prescott

[57] ABSTRACT

A gripping device and method for enhancing hand gripability of an elongated cylindrical exercise bar by a user during exercise. The device consists of a single resilient, flexible pad formed of a flat sheet of thin elastomeric material such as rubber, latex and the like. The pad is sized in length and width to cover substantially most of the user's palm and fingers up to the first joint. Being uncoated, the surfaces of the pad of elastomeric or latex, resist slippage. No adhesives or other attaching means are required to maintain the position and resilient shape of the device around the exercise bar; hand gripping pressure against the outer surface of the pad which is positioned between the exercise bar and the hand is sufficient for pad position retention.

1 Claim, 1 Drawing Sheet

GRIPPING DEVICE

BACKGROUND OF THE INVENTION

1. Scope of Invention

This invention relates generally to devices which increase hand gripping sureness, and more particularly to a gripping device for enhancing the gripability of a cylindrical exercise bar.

2. Prior Art

Those who exercise and train using one of many forms of a cylindrical elongated exercise bar quickly realize that inadequate sureness of one's hand grip of such exercise bars significantly diminishes the effectiveness of such exercise and training. These exercise bars may be in the form of horizontal bars from which the user pushes upwardly, overhead bars from which the user pulls and swings his body weight, as well as bar bells and dumb bells which are hand grasped by a cylindrical center portion thereof. Many multi-function exercise apparatus incorporate several cylindrical bars as well.

Conventional gloves are well known to be used by those who exercise and train utilizing or depending upon cylindrical exercise bars. Fabric, leather and elastomeric padded gloves have thus been utilized extensively as an economical and convenient means for both protecting the hands and enhancing gripability of the bars. However, gloves in and of themselves must be worn at virtually all times during the exercise period which may become an annoyance. Further, the gloves may actually interfere with gripping sureness by adding padding thickness between the hand and exercise bar, particularly at the outer fingertip area and thumb of the hand.

Several more specialized devices are known to applicant for enhanced hand gripability of exercise bars. One such device is disclosed in U.S. Pat. No. 4,752,499 invented by Pirie teaching a gripper pad for the hands including a pad covering the palm area of the hand and having finger loops on the pad through which all fingers extend for securing the device to the user's hand. Here again, the Pirie device is held in position at all times during exercise and it is believed that the finger loops would interfere with gripability of the exercise bar in the region between the palm and the first knuckle of each finger.

Perschke teaches a hand grip for gymnasts in U.S. Pat. No. 3,178,724 which discloses a hand guard formed of a flat sheet of resilient material having a slitted index finger hole formed at one end thereof and a wrist band formed by splitting the elastomeric material at the other end thereof. Again, the Perschke device must be worn at all times and does not cover substantially all of the important gripping areas, namely the palm and finger area to the first knuckle.

In U.S. Pat. No. 3,381,304, Coco teaches a hand guard provided in left and right hand forms which engages at one end around the index finger wrapping diagonally across the palm and around the wrist area and back to engage around the first and fourth finger of the user's hand. Thus, Coco provides a double layer of material crossing the important palm area of the user's hand and remains fully engaged with the hand during exercise.

In U.S. Pat. No. 3,896,498, a palm guard invented by Pang is there disclosed. A one-piece palm guard having a palm portion adapted to fit flat against and cover a major part of the palm of the user includes strip portions which extend from opposite ends of the palm portion to pass around the side edges of the hand and permanently jointed together to form a back strap. The Pang device does not cover the finger area to the first knuckle and additionally must be worn constantly during exercise.

A multi-function hand gripping device invented by DaSilva is disclosed in U.S. Pat. No. 5,350,343. This device includes both a hand pad and a wrist pad, the entire arrangement secured around the user's wrist. Although the hand pad is unconnected to the palm and fingers, nonetheless the entire device is intended to be secured in place and worn during all exercises.

Lastly, Roussel teaches a palm grip in U.S. Pat. No. 1,583,606 disclosing a formed strap-like member having a truncated thumb sleeve, the device extending across the palm and secured by a strap positioned at the back of the hand. This device appears cumbersome, expensive to manufacture and, again, is intended to be worn during an entire exercise period unless removed, then reinstalled.

The present invention teaches an extremely simple, economical to manufacture gripping device and method of enhancing one's grip of a cylindrical exercise bar which is completely separate from the user's hand except during use. The device, when properly positioned against the palm and fingers to the first knuckle of the user is then easily wrapable by hand grasping motion around the exercise bar during periods of exercise. Thereafter and therebefore, the device is foldable into a pocket size configuration for carrying.

BRIEF SUMMARY OF THE INVENTION

This invention is directed to a gripping device and method for enhancing hand gripability of an elongated cylindrical exercise bar by a user during exercise. The device consists of a single resilient, flexible pad formed of a flat sheet of thin elastomeric material such as rubber, latex and the like. The pad is sized in length and width to cover substantially most of the user's palm and fingers up to the first joint. Being uncoated, the surfaces of the pad of elastomeric or latex, resist slippage. No adhesives or other attaching means are required to maintain the position and resilient shape of the device around the exercise bar; hand gripping pressure against the outer surface of the pad which is positioned between the exercise bar and the hand is sufficient for pad position retention.

It is therefore an object of this invention to provide a gripping device which significantly enhances the gripability of cylindrical elongated exercise bars during pushing, pulling or lifting exercises and training.

It is another object of this invention to provide a gripping device for enhanced gripability of exercise bars which is not physically attached to the user's hand either during exercise and training maneuvers or thereafter or therebefore.

It is another object of this invention to provide a gripping device which covers substantially all of the user's palm and fingers to the first knuckle for enhanced gripability and sureness when exercising in conjunction with a cylindrically elongated exercise bar of various forms.

It is another object of this invention to provide a method of enhancing one's gripping sureness of an elongated cylindrical exercise bar of various forms during various exercise and training maneuvers.

In accordance with these and other objects which will become apparent hereinafter, the instant invention will now be described with reference to the accompanying drawings.

DETAILED DESCRIPTION OF THE INVENTION

Figure 1:
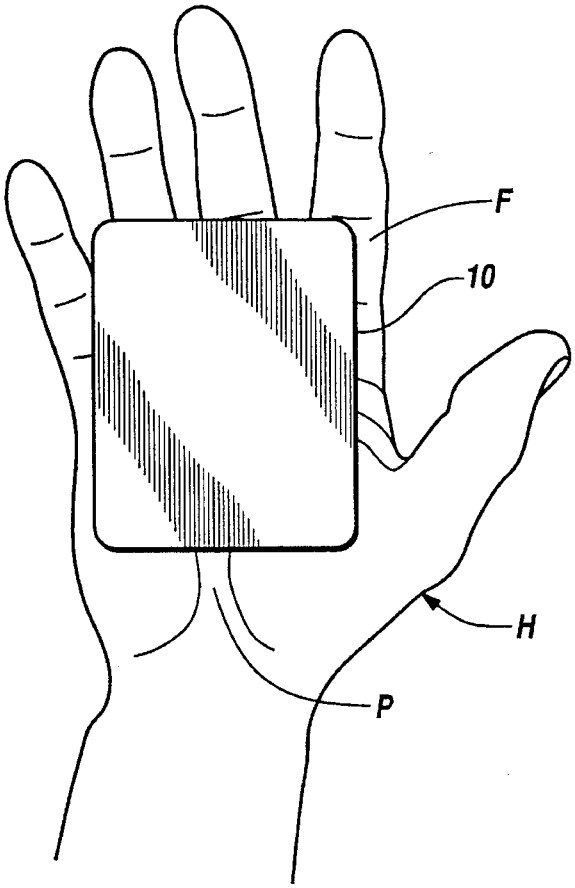
FIG. 1 is a perspective view of the preferred embodiment of the invention positioned in a user's hand ready for use.
Figure 2:
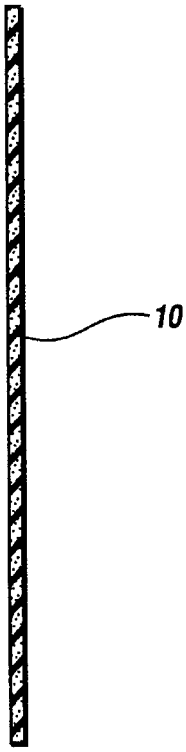
FIG. 2 is a section view of the device shown in FIG. 1.

Referring now to the drawings, and particularly to FIGS. 1 and 2, the preferred embodiment of the invention is shown at numeral 10. The device 10 consists of a single elastomeric pad formed of flexible, resilient flat elastomeric material. Thickness in the range of 1/32" to as large as 1/4"; however, thinner materials in the range of 1/32" to 1/16" are preferred.

The device 10 as seen in FIG. 1 is preferably rectangular in size having rounded corners and having a width and length so as to extend to cover substantially all of the palm area P of a typical user's hand H along with covering all fingers up to the first knuckle F (typ.).

In use, the user simply lays the device 10 in the palm of the hand as shown in FIG. 1 and then grasps the elongated cylindrical exercise bar (not shown) with the device 10 being simultaneously wrapped around the exercise bar against the palm P and finger area to the first knuckle F by the normal gripping action of the hand H.

The device 10 is thus conveniently usable in conjunction with cylindrical exercise bars designed for pushing exercises such as parallel bars, lifting exercises such as chin-up and trapeze bars, weight lifting of bar bells and dumb bells and the like. By this arrangement, the user only has to deal with the device 10 during actual exercising and training maneuvers. Otherwise, the device 10 may be either carried in the pocket or laid aside for later use.

Importantly also, the device 10 does not cover the finger area beyond the first knuckle F (typ.), an important feature for allowing the user to have direct finger touching and thumb contact with the exercise bar for enhanced sensitivity.

Two additional features of the device are noted. First, by structuring the device from sheet elastomeric material such as neoprene, latex and the like, both surfaces thereof are of a non-skid nature to resist slippage both against the surface of the exercise bar and the palm and finger area of the hand. Secondly, the sheet elastomeric material, even of a minimal thickness of 1/32", provides sufficient padding through compressibility to reduce localized pressure against skin tissue covering bony prominences of the hand.

Figure 3:
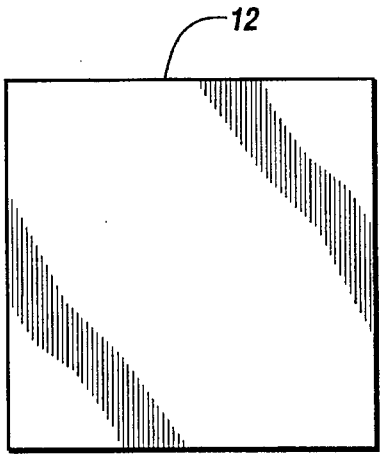
FIG. 3 is a plan view of another embodiment of the invention.
Figure 4:
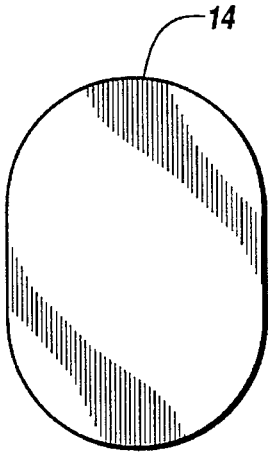
FIG. 4 is a plan view of yet another embodiment of the invention.
Figure 5:
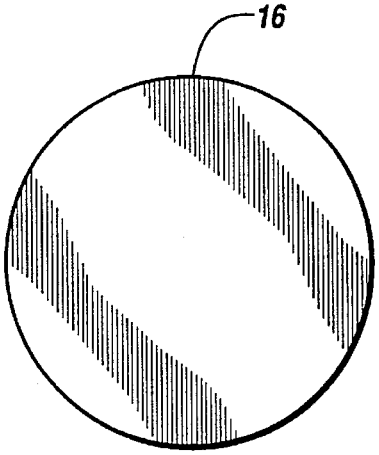
FIG. 5 is a plan view of still another embodiment of the invention.

Referring now to FIGS. 3, 4 and 5, three additional embodiments with respect to profile or plan view shape are there shown at 12, 14 and 16. All alternate embodiments 12, 14 and 16 are sized in overall length and width so as to cover substantially all of the palm area P of the hand H and a substantial portion of the fingers to the first joint F.

Again, it is noted that the device is completely unattached to either the exercise bar or the hand of the user, yet is held in secure position during use so as to resist slippage both against the exercise bar and the palm and finger area of the user's hand even when sweat and perspiration would otherwise inhibit such gripability. Further, the device 10 being made of elastomeric material, latex and the like may be easily washed with mild soap and water to remove any soil, perspiration and oil build-up to return the surfaces to original non-skid condition.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A method of enhancing and cushioning hand gripping of an elongated cylindrical exercise bar by a user during exercising comprising the steps of:

A. providing a gripping device for each hand of the user consisting of:

a single resilient, flexible pad formed of a flat sheet of elastomeric material having smooth, continuous surfaces;

said pad sized in length and width to only cover a substantial portion of a palm area and fingers up to the first joints of a user;

B. positioning one said gripping device against each hand of the user ready for bar engagement;

C. grasping the bar with said gripping device being resiliently flexibly wrapped around the bar by the hand, said pad being held in an in-use position partially encircling an elongated cylindrical exercise bar only by hand gripping action of the bar by the user with said pad positioned therebetween.

* * * * *